US006083024A

United States Patent [19]

Mezin et al.

[11] Patent Number: 6,083,024

[45] Date of Patent: Jul. 4, 2000

[54] ELECTRICAL CONNECTOR ASSEMBLY WITH REDUCED WEAR AND MATING FORCES

[75] Inventors: Theirry Mezin, Houilles; Alexandre Rosi, Cergy, both of France; Lucas Soes, Rosmalen; Howard Robert Tan, Eindhoven, both of Netherlands

[73] Assignee: The Whitaker Corporation, Wilmington, Del.

[21] Appl. No.: 09/062,607

[22] Filed: Apr. 20, 1998

[30] Foreign Application Priority Data

Apr. 25, 1997 [EP] European Pat. Off. ..... 97400947

[51] Int. Cl.[7] ..... H01R 11/22

[52] U.S. Cl. ..... 439/268; 439/856

[58] Field of Search ..... 439/268, 265, 439/260, 261, 262, 263, 267, 344, 346, 350, 351, 783, 834, 270, 852, 856, 842, 857, 861, 862

[56] References Cited

U.S. PATENT DOCUMENTS

| | | | |
|---|---|---|---|
| 2,992,401 | 7/1961 | Lewis | 339/22 |
| 4,350,402 | 9/1982 | Douty et al. | 339/74 R |
| 4,553,802 | 11/1985 | Ruehl | 339/74 R |
| 4,618,199 | 10/1986 | Pfaff | 339/74 R |
| 5,338,219 | 8/1994 | Hiramoto et al. | 439/350 |
| 5,380,217 | 1/1995 | Yagi et al. | 439/358 |
| 5,393,250 | 2/1995 | Richardson et al. | 439/825 |
| 5,685,746 | 11/1997 | Maejima | 439/845 |
| 5,836,793 | 11/1998 | Chaillot et al. | 439/852 |

FOREIGN PATENT DOCUMENTS

| | | | |
|---|---|---|---|
| 0 308 068 B1 | 11/1995 | European Pat. Off. | H01R 13/11 |
| 31 10 609 A1 | 10/1982 | Germany | H01R 13/639 |
| 32 42 635 A1 | 9/1983 | Germany | H01R 13/11 |
| 2 286 492 | 8/1995 | United Kingdom | H01R 9/09 |

*Primary Examiner*—Paula Bradley
*Assistant Examiner*—Ross Gushi

[57] ABSTRACT

A connector assembly comprises a male connector with pin terminals, and a female connector with receptacle terminals matable therewith. The male terminal comprises a separator protrusion adjacent the contact engageable with separating extensions of contact arms of the female terminal. During coupling, the contact arms are biased apart by engagement with the separator protrusion thereby preventing rubbing of the contact surfaces during initial coupling. The latter reduces wear of the contact surfaces and also reduces mating forces.

6 Claims, 8 Drawing Sheets

16'
19
86
32
84
88
70
18
40
82
36
17
78
30
38

6
19
77
84
70
72
36
76
6
80
4
74
90

19
84
73
70
90
5
76
80

36
14
84
73
72
18
80

ELECTRICAL CONNECTOR ASSEMBLY WITH REDUCED WEAR AND MATING FORCES

BACKGROUND OF THE INVENTION

1. Field of the Invention

This invention relates to an electrical connector assembly with means for reducing the mating forces and reducing contact wear.

2. Description of the Prior Art

In U.S. Pat. No. 2,992,401, a connection assembly is disclosed comprising a first connector having a plurality of bus bars for mating with receptacle terminals mounted in a complementary connector. The receptacle terminals are received in channels of the first connector aligned with the bus bars. Protrusions are provided in the cavities proximate mating ends of the bus bars such that cantilever beam contact arms of the receptacle terminals are pried apart prior to insertion of the bus bar between cantilever beam contact arms of receptacle terminal.

The protrusions may be formed of a smooth profile from the insulating material of the housing such that force required to pry apart the receptacle terminal contact arms is lower than if the contact arms were pried apart by the bus bar. It is easier to adapt the profile of the projection to an ideal contact separating profile in view of reducing mating forces, than adapting the tip of the bus bar. Housings are typically injection moulded where complex profiles can be easily formed, compared to terminals which are made typically of stamped and formed metal. Furthermore, the coefficient of friction between housings (typically made of plastic) and the metal contact arms of the receptacle contact is lower than between mating contacts. Furthermore, separating the receptacle contact arms with the protrusion reduces contact wear.

The above described connector assembly however is longer in view of the extra length required for the cavities and protrusion. It is a desire not only to render connectors more compact, but to reduce costs while increasing reliability.

For example certain applications contact surfaces are provided with a thin layer of gold in order to prevent corrosion forming on the contact surfaces which leads to increased contact resistance. In order to save gold and decrease plating times, it is desirable to provide a very thin gold layer. In conventional connectors however after a few plugging and unplugging cycles the gold layer is often rubbed away. Although utilization of a concept according to U.S. Pat. No. 2,992,401 would enable an increase in the number of mating cycles, the contact surfaces of the terminals nevertheless rub against the insulator, which may eventually lead to the gold wearing through. A further problem is the risk of plastic from the protrusions rubbing off onto the contact points thereby increasing contact resistance or even insulating the contacts.

It is also increasingly important to provide robust connectors, and in particular robust terminals with low risk of damage such that reliable interconnection is provided, particularly where electrical interconnections relate to safety devices.

A further important aspect in order to provide reliable interconnection is to ensure that complete mating and electrical connection occurs when coupling connectors together. In particular, an intermediate position where mating contacts are only partially coupled is undesirable.

SUMMARY OF THE INVENTION

It is an object of this invention to provide an electrical connector assembly and terminals therefore that enable reliable interconnection with reduced mating forces and reduced wear of contact surfaces.

The objects of this invention have been achieved by providing the connector assembly according to claim 1, and the terminal according to claim 6 which may be used in the connector assembly according to claim 1. Disclosed herein is a connector assembly comprising a first connector with male contact portions, and a second connector matable therewith having terminals with female contact portions comprising at least one spring arm with a contact surface for resilient abutment against the male contact portion of the fist connector, the first connector comprising an insulative housing having separator projections extending therefrom adjacent the pin contact portions, wherein the spring arm of the mating female terminal comprises a separator extension extending from the spring arm in a direction transverse to the direction of coupling of the connectors and arranged to engage the separator extension during coupling such that the contact surface of the female terminal is biased away from the male contact portion. The profile of the separator protrusion is adapted to enable inward biasing of the female terminal contact surface against the male contact portion when the connectors are fully coupled. Advantageously therefore, the resilient contact arm is biased out of contact with the mating male contact during initial coupling thereby reducing mating forces and contact wear, whilst enabling a compact connector to be provided. Particularly low contact wear is enabled as the separator engages the lateral extension of the contact rather than rubbing on the contact surface thereof. Also risk of contaminating the contact surface with insulative housing material is avoided. A further important advantage is that partial coupling is avoided. Either the contacts are disconnected or once they pass the protrusions, the connectors are encouraged into full mating by the resilient force of the contact arms on the trailing end of the separator protrusions.

Also disclosed herein is an electrical terminal stamped and formed from sheet metal and comprising a connection section for connection to a conductor, a contact section for receiving a male pin or tab terminal, the contact section comprising a pair of cantilever beam spring contact arms arranged in an opposed fashion extending from opposed side walls and converging to opposed contact surfaces proximate free ends of the contact arms, the contact arms further provided with separator extensions extending laterally from the contact arms proximate the free ends thereof, wherein the contact further comprises a protective cage having a base wall and opposed side walls extending from lateral edges thereof that extend alongside the contact arms, such that the contact arms are substantially enclosed by the cage, except for a passage above the lateral extensions of the contact arms for allowing passage of a separator protrusion between the lateral extensions from a top side of the terminal. Advantageously therefore, a well protected, compact, and cost effective terminal may be provided with lateral separator extensions.

Further advantageous aspects of the invention will be described in the claims, or will be apparent from the following description and drawings.

BRIEF DESCRIPTION OF THE DRAWINGS

FIG. 3 is a top view of a terminal of another embodiment according to this invention;

DETAILED DESCRIPTION OF THE PREFERRED EMBODIMENT

Figure 1:
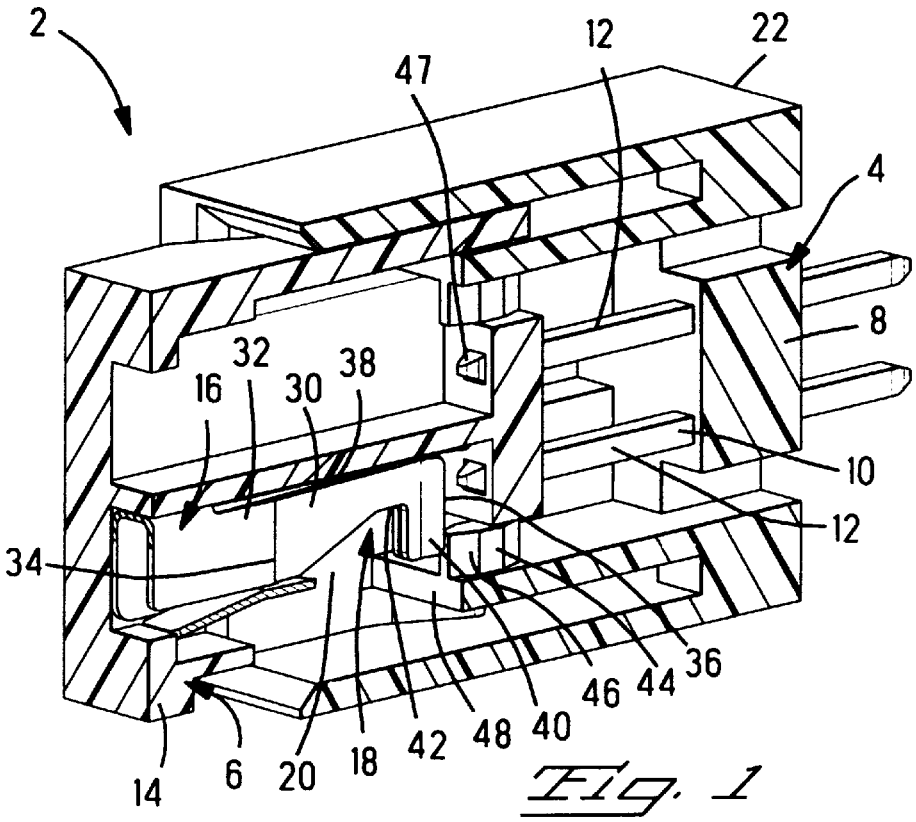
FIG. 1 is a cross-sectional view through a first embodiment of a connector assembly according to this invention, where only part of the connector assembly is shown in a cross-sectional isometric view, and where connectors thereof are about to be coupled together.

Referring to the Figures, particularly FIGS. 1 and 2, and FIGS. 8 and 9, an electrical connector assembly 2 comprises a male connector 4 and a female connector 6 matable therewith. The male connector 4 comprises an insulative housing 8 and a plurality of terminals 10 mounted in the housing, the terminals having male contact portions 12 which in these embodiments are substantially elongate pin contact sections.

Figure 9:
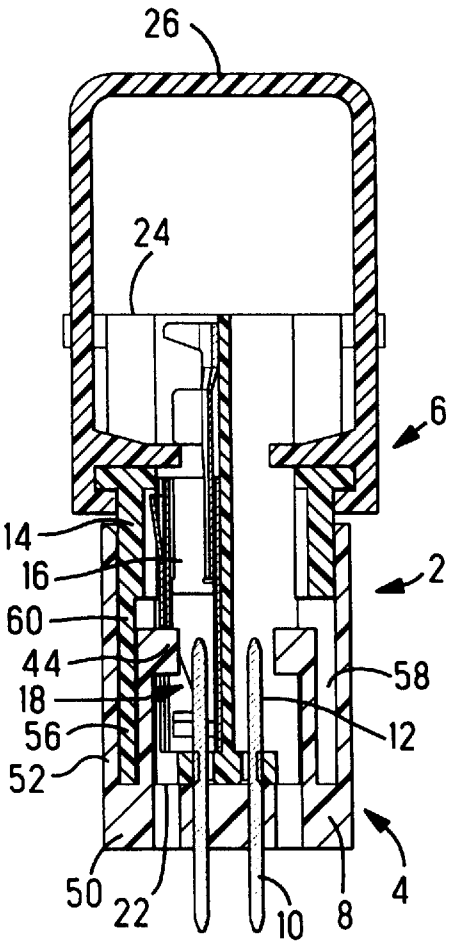
FIG. 9 is a cross-sectional view through lines 9—9 of FIG. 8.
Figure 8:
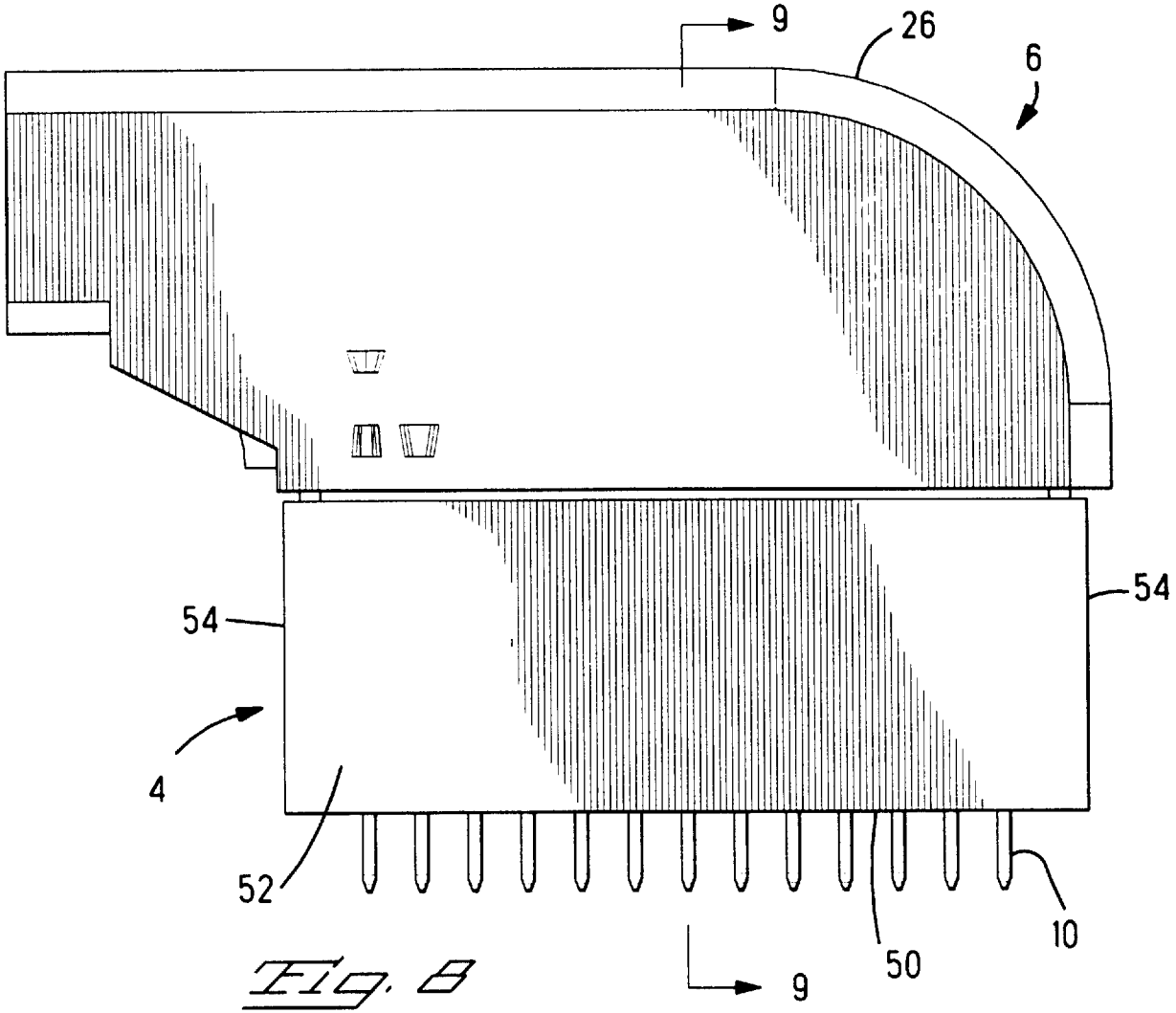
FIG. 8 is a side view of another embodiment of a connector assembly fully coupled.
Figure 10:
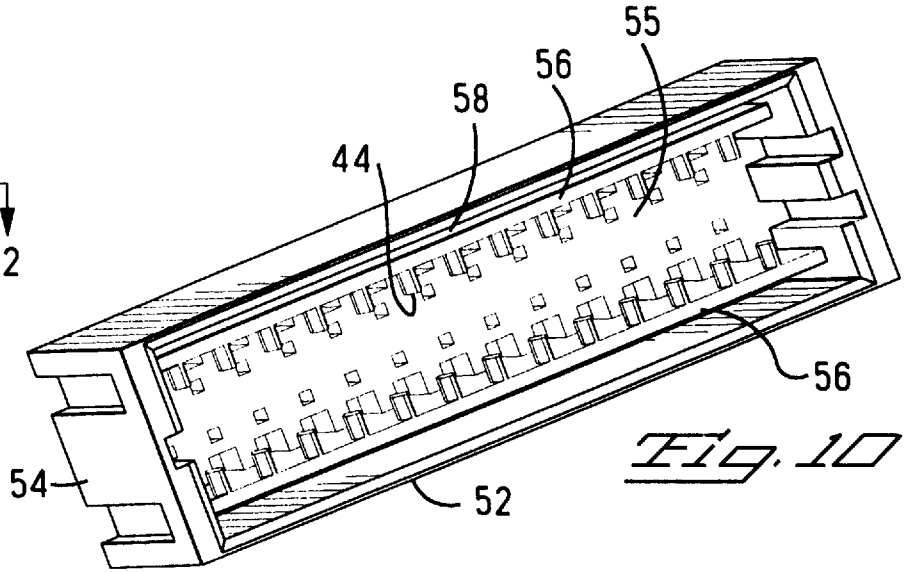
FIG. 10 is an isometric view of an insulative housing of a male connector of the embodiment of FIGS. 8 and 9.
Figure 13:
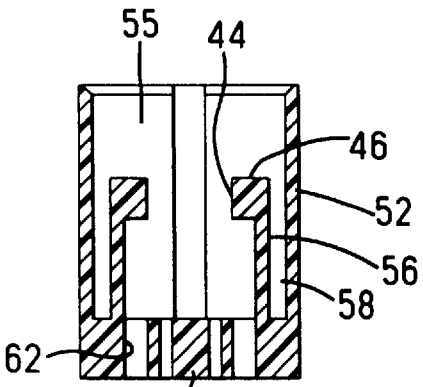
FIG. 13 is a cross-sectional view through lines 13—13 of FIG. 12.
Figure 11:
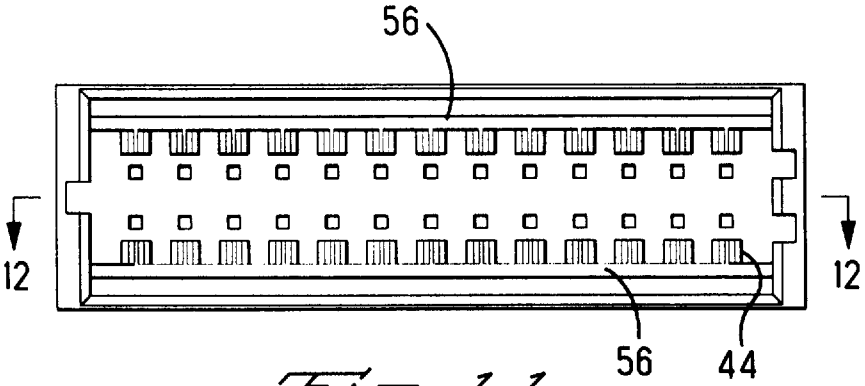
FIG. 11 is a plan view towards the mating face of the housing of FIG. 10.
Figure 12:
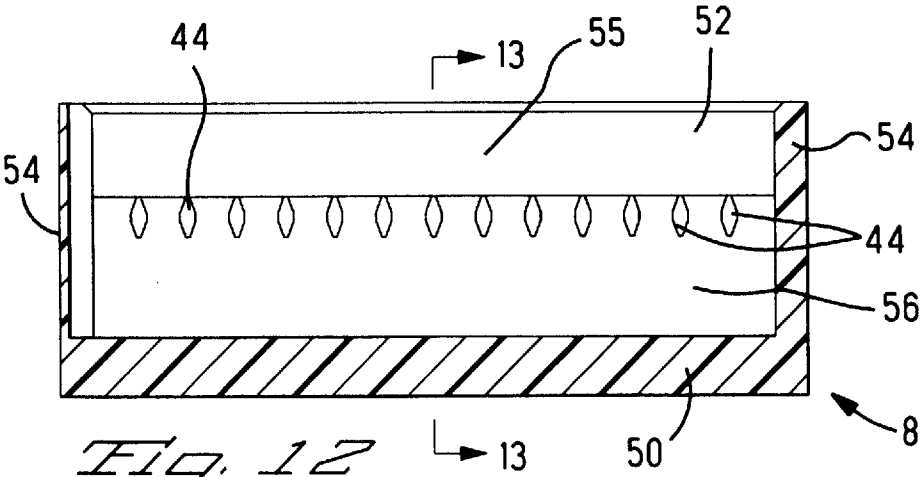
FIG. 12 is a cross-sectional view through lines 12—12 of FIG. 11.
Figure 15:
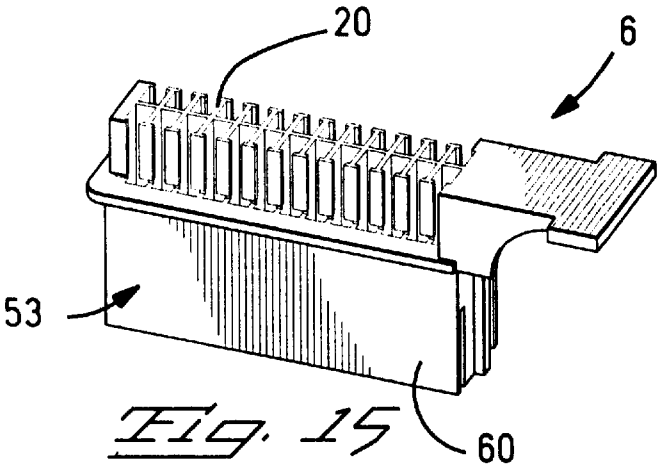
FIG. 15 is a further isometric view of the housing of FIG. 14.
Figure 18:
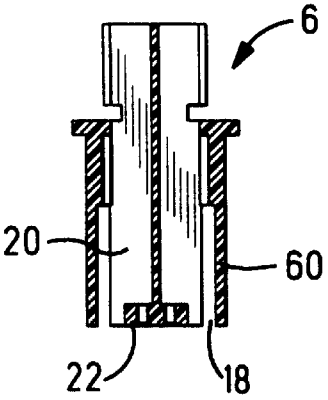
FIG. 18 is a cross-sectional view through lines 18—18 of FIG. 16.
Figure 17:
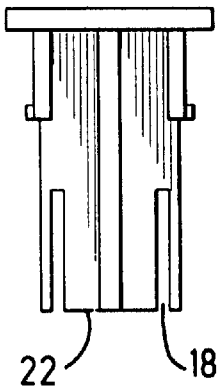
FIG. 17 is a view in the direction of arrow 17 of FIG. 16.
Figure 14:
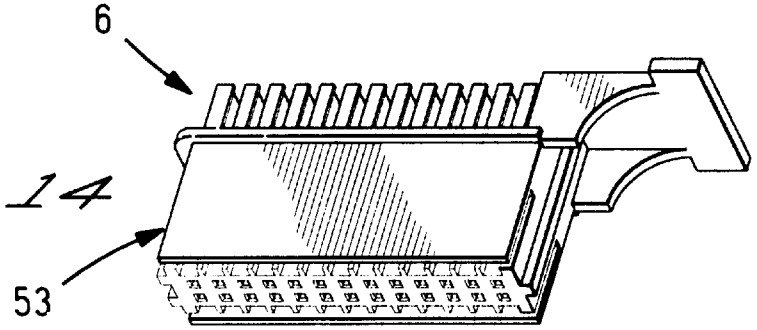
FIG. 14 is an isometric view of a housing of a complementary female connector of the embodiment of FIGS. 8 and 9.
Figure 16:
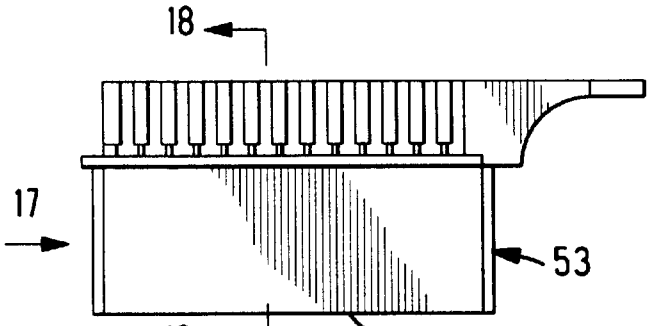
FIG. 16 is a side view of the housing of FIGS. 14 and 15.
Figure 19:
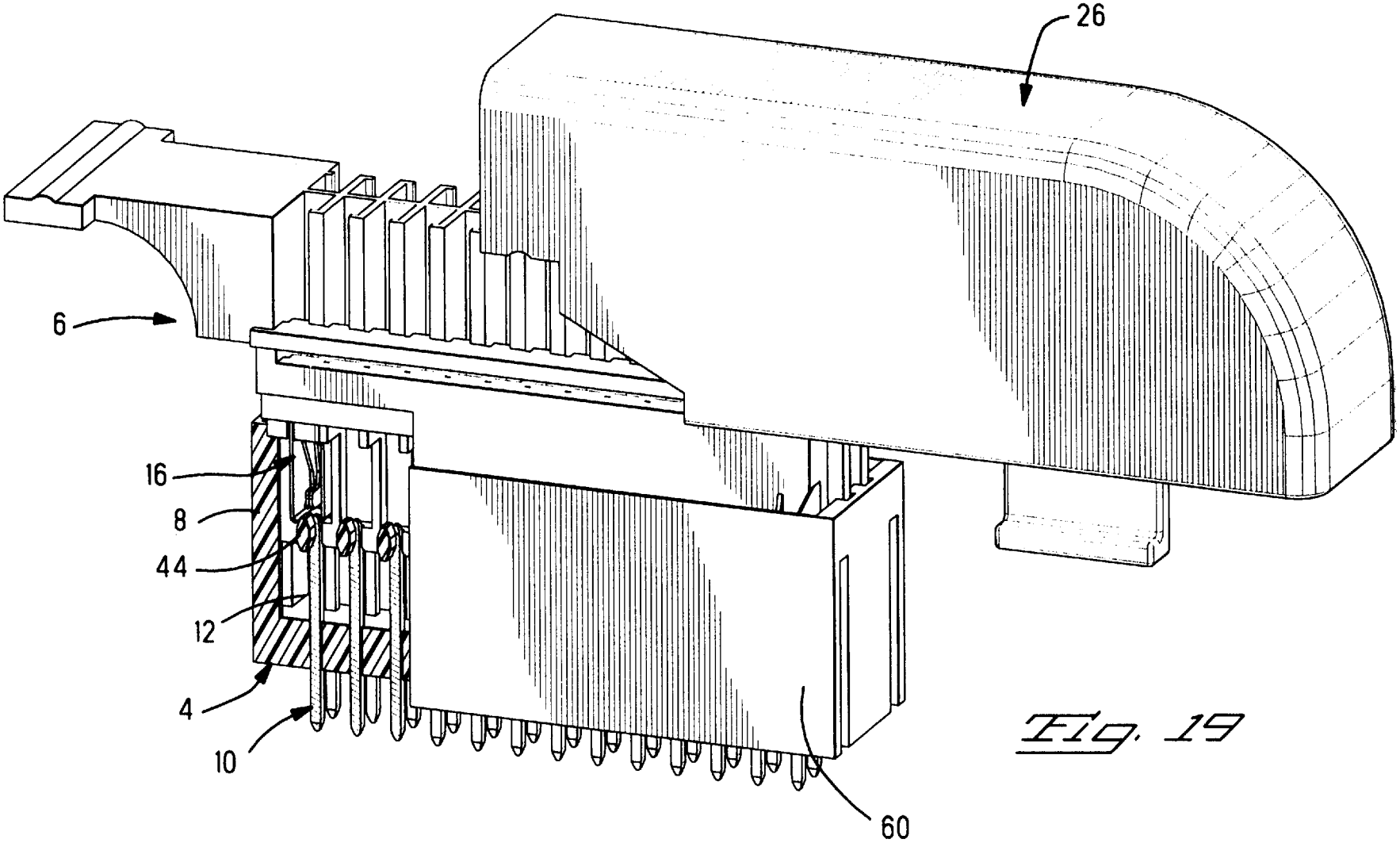
FIG. 19 is a partial cross-sectional isometric view of a partially assembled connector assembly according to the embodiment of FIG. 8.

The female connector 6 comprises an insulative housing 14 and a plurality of terminals 16 mounted therein, the terminals comprising female contact portions 18 received in terminal receiving cavities 20 that extend from a mating end 22 to a terminal receiving face 24 of the housing. In the embodiment of FIGS. 8 and 9, the female connector is further provided with a cover 26 slidably mounted over the terminal receiving face 24 in order to protect and guide cables attached to the terminals 16.

The contact section 18 of the terminal 16 comprises a pair of opposed spring arms 30 in the form of cantilever beams attached to side walls 32 of the terminal towards a conductor attachment section 19 thereof, each contact spring arm 30 extending from an attachment end 34 to a free end 36 directed towards the mating end 22. Proximate the free end 36 are contact surfaces 38 for resilient abutment against the male contact portion 12 of the mating terminal 10. The contact arms 30 are further provided with separator extensions 40 projecting from a lateral edge 42 of the arm proximate the free end 36 for engaging a complementary separating protrusion 44 of the male connector 4.

Figure 2:
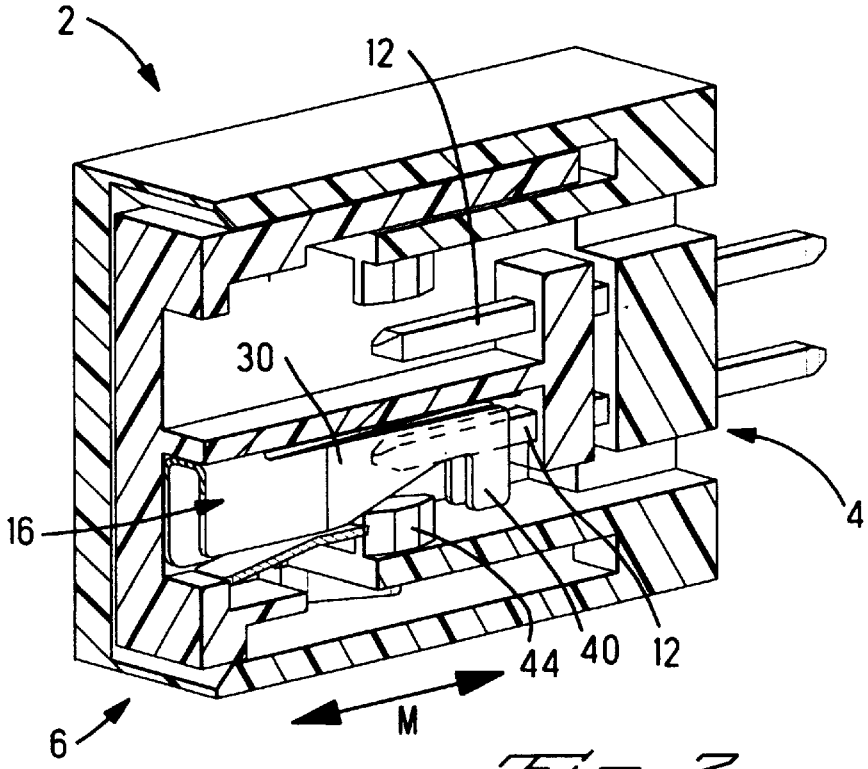
FIG. 2 is a view similar to that of FIG. 1 of the connectors fully coupled.
Figures 4, 5, 6, 7:
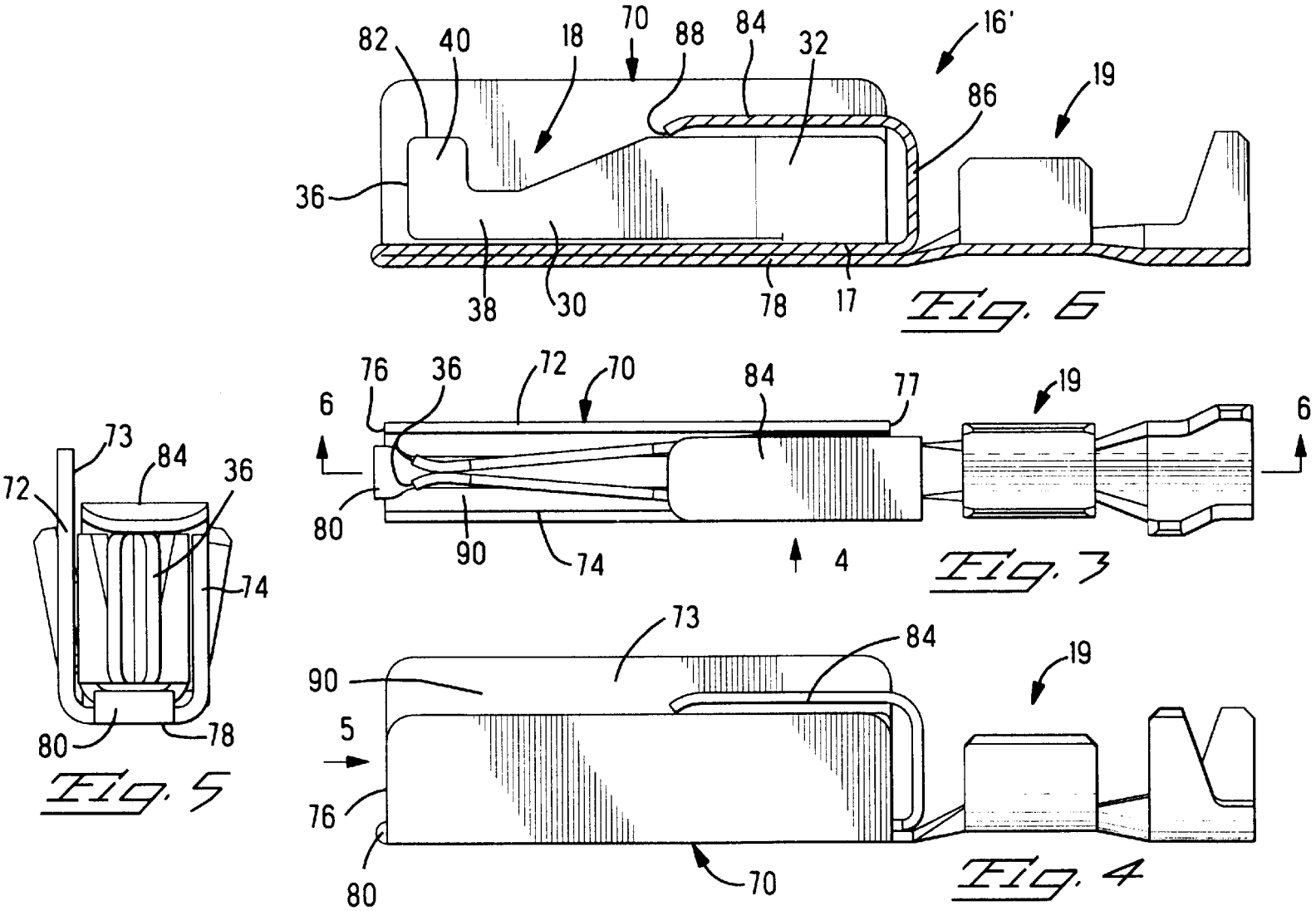
FIG. 4 is a view in the direction of arrow 4 of FIG. 3.
FIG. 5 is a view in the direction of arrow 5 of FIG. 4.
FIG. 6 is a cross-sectional view through lines 6—6 of FIG. 3.
FIG. 7 is an isometric view of the terminal according to FIGS. 3–6.
Figure 7:
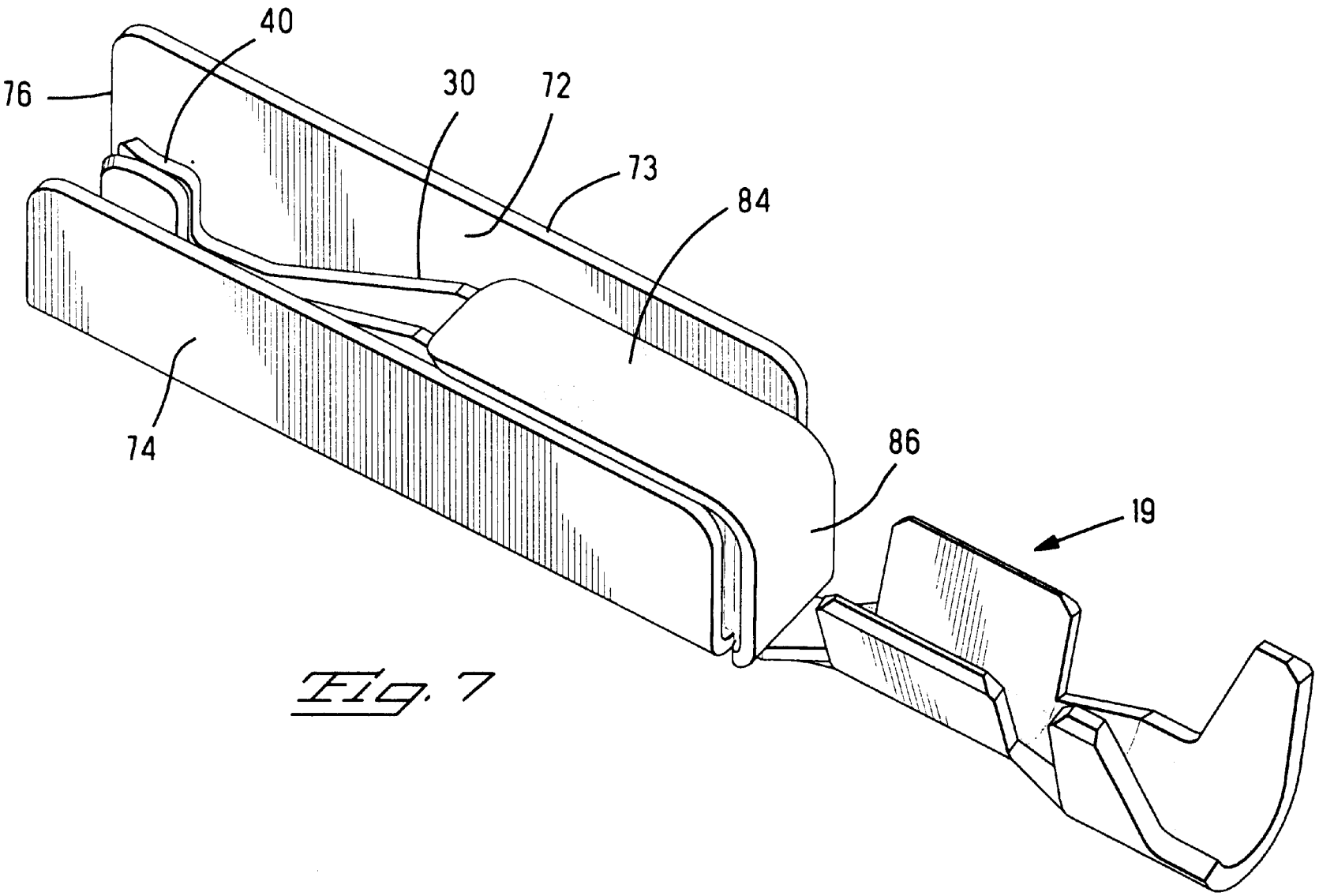

The separating protrusion 44 is prismatic and extends substantially orthogonally from the housing 8, and can be made integrally therewith by moulding for example, and positioned alongside the male contact portion 12. A mating end 46 of the protrusion is tapered or rounded to engage smoothly the separating extensions 40 in order to prise them apart during coupling (mating) of the connectors 4,6. The mating end 46 of the protrusion 44 extends slightly beyond a mating end 47 of the terminal 10 towards the connector mating end 48 such that the contact arms 30 are resiliently prised apart prior to engagement of the terminal 10 with the contact arms 30. Once the connectors are fully mated as shown in FIG. 2 or FIG. 9, the extensions 48 no longer engage the protrusion 44 in order to allow the biasing of the contact surfaces 38 against the male contact portion 12.

Depending on the application, the length of the protrusion 44 in the mating direction M may be varied in order to allow for some rubbing action between the mated contact surfaces in order to remove dirt or oxide layers as the case may be. The positioning of the protrusion 44 alongside the male contact portion 12 permits a compact connector assembly to be provided, whilst further enabling reception of connectors with various pin lengths or rubbing distance to be easily adjusted by adjusting the length of the protrusion 44. Additionally, as the friction co-efficient between metal and plastics typically used for connector housings is usually less than between the metal contact surfaces of terminals, the mating force needed to couple the connectors is reduced. Furthermore, the profile of the protrusion mating end 46 can be optimally profiled to further reduce mating forces.

Referring now more particularly to FIGS. 8–18 details of an embodiment of the connector assembly will be described more thoroughly. The male connector housing 8 comprises a base wall 50 and side and end walls 52,54 forming a shroud surrounding a cavity 55 for receiving a mating section 53 of the female connector therein. Extending along the side walls 52 within the connector receiving cavity 55 are support walls 56 upstanding from the base wall 50 for supporting the separator protrusions 44. The separator support walls 56 are positioned substantially parallel and slightly spaced from the side walls 52 by a gap 58 for receiving an outer wall 60 of the mating section 53 of the female connector 6. This construction enables the terminals of both the male and female connectors to be enclosed within housings thereby providing connectors with well protected terminals. The passages 62 (FIG. 13) through the base wall (50) below the protrusions 44 are to enable pins of a moulding die to pass therethrough for forming the separator protrusion 44. 15 Referring to FIGS. 3–7, an embodiment of a receptacle terminal 16' for assembly in the receptacle connector 6 shown in FIG. 9, comprises the features of the terminal discussed above and in addition further features. The features already discussed will be denoted with the same numbering.

The terminal 16' comprises a female contact portion 18 and a connection section 19 for connection to a complementary conductor, which in this embodiment is for crimping to a conducting wire. The contact section 18 comprises a pair of opposed spring arms 30 with contact surfaces 38 and separating extensions 40 proximate the free end 36 as described for the terminal according to FIG. 1. The contact spring arms 30 extend from side walls 32 of an inner body, the side walls extending from lateral edges of an inner base wall 17. The inner base wall 17 is integrally joined to a cage 70 that has side walls 72,74 arranged on outer sides of the contact section 18 and extending alongside the contact arms 30 to a mating end 76, the side walls 72,74 joined to a base wall 78 adjacent the inner base wall 17. In this embodiment, the inner base wall 17 is integrally joined to the cage base wall 78 via a fold 80 at the mating end 76. The terminal can thus be formed as an integral single body stamped and formed from sheet metal, thus providing a cost-effective terminal to manufacture. The mating end 76 of the cage extends beyond the free end 36 of the contact arms 30, and the cage side walls 72, 74 extend beyond the outer lateral end 82 of the separating extension 40 in order to enclose the inner terminal for protection thereof. One of the side walls 72 is provided with a polarising extension 73 that extends towards a top end beyond the other side wall 74. The latter enables the terminal 16' to be correctly oriented in the housing terminal receiving cavity 20.

The cage 70 may further by provided with a top wall 84 that comprises a folded over extension of the inner base wall 17 through a connection end wall 86 proximate the connection section 19. The top wall 84 extends to a front end 88 positioned intermediate the mating end 76 and connection end 77 of the cage. A portion of a top face 90 between the top wall forward end 88 and the mating end 76 is open for access of the separating protrusion 44 therethrough during coupling of the connectors. A particularly simple but robust terminal is thus provided that enables cooperation with the separating protrusions.

Figure 20:
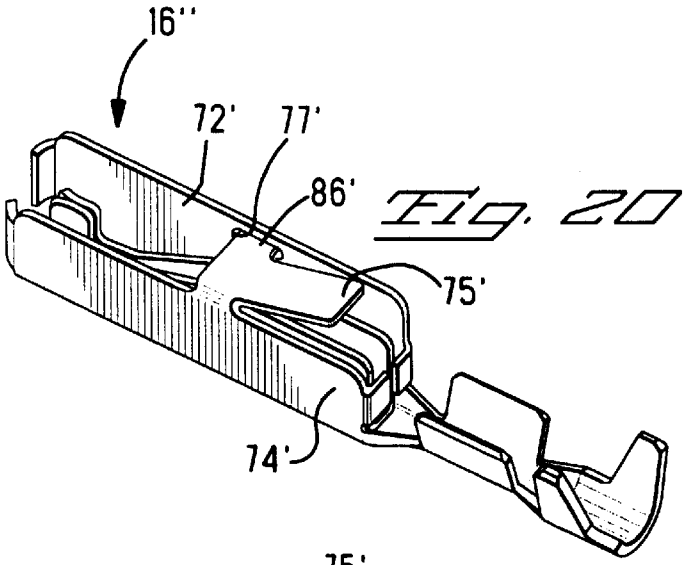
FIG. 20 is an isometric view of another embodiment of a receptacle terminal.
Figure 24:
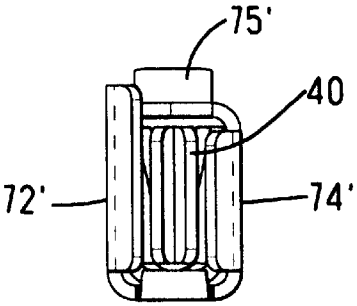
FIGS. 21–24 are various views of the terminal of FIG. 20.
Figure 23:
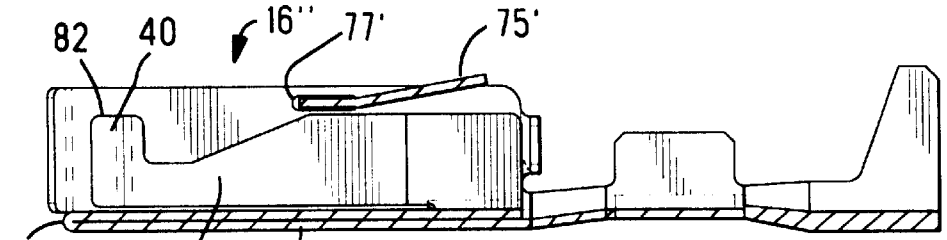
Figure 21:
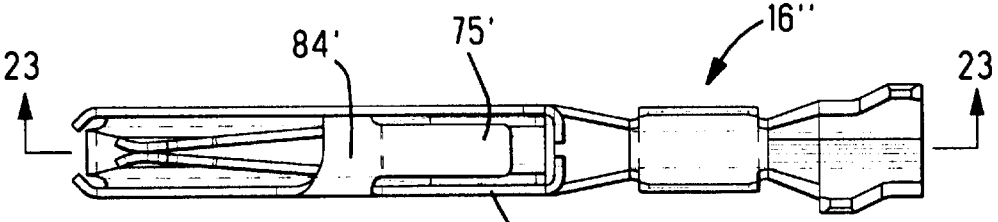
Figure 22:
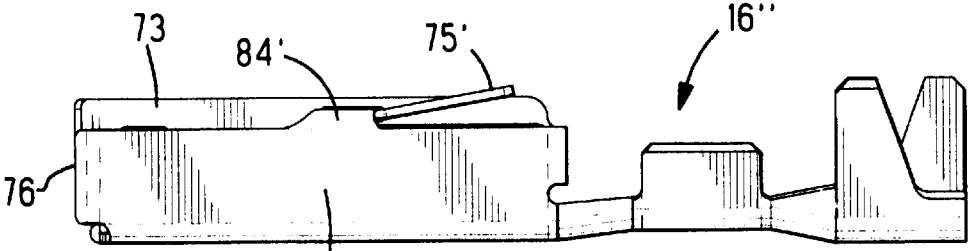

In FIGS. 20–24, another embodiment of a terminal 16" with cage is shown. The embodiment of FIG. 20 is substantially identical to the terminal shown in FIGS. 3–6 except for the top wall 84' which extends integrally from the side wall 74' and is provided with a locking lance 75'. The top wall 84' joins the other side wall 72' and may either be welded thereto or fixed by interengaging tab means 77' in order to provide a robust box-shaped structure.

I claim:

1. A connector assembly comprising a first connector having terminals with male contact portions, and a second connector matable therewith having terminals with female contact portions comprising at least one spring arm with a contact surface for resilient abutment against the male contact portion of the first connector, the first connector comprising an insulative housing having separator projections extending therefrom, wherein the separator projections are positioned alongside the male contact portions, and the spring arm of the mating female terminal comprises a separator extension extending away from the contact surface arm in a direction transverse to the direction of coupling of the connectors, the separator extension arranged to engage the separator projection independently of the contact surface during coupling such that the contact surface of the female contact portion is biased away from the male contact portion, the profile of the separator projection further arranged to enable inward biasing of the female contact portion against the male contact portion when the connectors are fully coupled.

2. The assembly of claim 1 wherein the separator projection is substantially prismatic and extends substantially orthogonally to the mating direction.

3. The assembly of claim 1 wherein the separator projection is integrally moulded with the insulative housing of the first connector.

4. The assembly of claim 1 wherein the terminal is integrally formed from a single piece of sheet metal.

5. The assembly of claim 1 wherein the separator projections are provided on support walls extending alongside and between outer side walls of the housing.

6. The assembly of claim 5 wherein the second connector includes a side wall extending to a mating end of the housing proximate a mating end of the female contact portions, the side wall being received in a slot of the male connector between the side wall and support wall thereof during coupling of the connectors.

* * * * *